United States Patent [19]

Nakayama et al.

[11] Patent Number: 4,526,476

[45] Date of Patent: Jul. 2, 1985

[54] CORRECTION SYSTEM FOR HANDS DISPLAY TYPE OF ELECTRONIC TIMEPIECE

[75] Inventors: Yasuaki Nakayama; Yasuo Kamiyama, both of Tanashi, Japan

[73] Assignee: Citizen Watch Company Limited, Tokyo, Japan

[21] Appl. No.: 517,875

[22] Filed: Jul. 27, 1983

[30] Foreign Application Priority Data

Jul. 30, 1982 [JP] Japan ..... 57-133202

[51] Int. Cl.[3] ..... G04C 9/00

[52] U.S. Cl. ..... 368/189; 368/187; 368/69

[58] Field of Search ..... 368/156, 160, 69, 73, 368/74, 76, 80, 251, 259, 260, 184, 185, 190, 189

[56] References Cited

U.S. PATENT DOCUMENTS 4,034,551 7/1977 Ushiyama ..... 368/189

*Primary Examiner*—Bernard Roskoski

*Attorney, Agent, or Firm*—Jordan and Hamburg

[57] ABSTRACT

A correction system for a hands display type of electronic timepiece which can display a plurality of types of time information such as an alarm time and the current time by a single set of hands, with changeover between display of the different types of information being performed by rapid rotation of the hands, with the system being characterized in that means are provided for inhibiting any input of correction signals by external switch actuations while such changeover is in progress. Errors resulting from accidental switch actuations during display changeover are thereby effectively eliminated.

5 Claims, 6 Drawing Figures

| Fig. 2A | Fig. 2B |
|---|---|

| Fig. 3A | Fig. 3 B | Fig. 3 C |
|---|---|---|

86
84
FORWARD ROTATION WAVEFORM SHAPING CIRCUIT
85
REVERSE ROTATION WAVEFORM SHAPING CIRCUIT
87
94
100
TIMER COUNTER CIRCUIT
110
Q
φ
114
R
109
TIMER CIRCUIT 132
70
φ
Q
S
φ
Q
S
72
112

CORRECTION SYSTEM FOR HANDS DISPLAY TYPE OF ELECTRONIC TIMEPIECE

BACKGROUND OF THE INVENTION

The present invention is directed toward a hands display type of electronic timepiece having a plurality of display functions, and in which a single set of hands are selectively utilized to display two or more types of time information, such as the current time and a preset alarm time, as designated by the user.

With such an electronic timepiece, changeover from display of one type of time information to display of another type of time information is generally performed by rotating the hands at high speed into positions indicating the new time information to be displayed. However a serious problem which arises with prior art electronic timepieces of this type lies in the fact that the user may accidentally apply an input to the timepiece circuits while such display changeover is in progress, with the result that there is an error in the information that is displayed when such changeover is completed. There is in fact a strong possibility of such erroneous inputs being applied, since the display changeover time interval may be relatively long. For example in the case of a timepiece in which the motor rotates by one step every 20 seconds, so advancing the hands once every 20 seconds, even with high speed hands rotation with the stepping motor of the timepiece being advanced by a drive signal comprising drive pulses at a rate of 64 Hz, it will take 3 seconds for the hands to be advanced by an amount representing one hour on the dial. Thus, there is a danger that the user may accidentally cause an input error by touching a correction switch while display changeover is in progress.

It is an objective of the present invention to overcome such problems, by providing a correction system whereby hands position correction operations are inhibited until display changeover has been completed.

SUMMARY OF THE INVENTION

The present invention comprises a correction system for an electronic timepiece of hands display type, in which a number of different types of information, for example an alarm time and the current time, can be displayed as required, using a single set of hands, whereby input of correction signals resulting from external switch actuations are inhibited so long as changeover of the hands positions from indication of one type of information to indication of another is in progress, whereby errors resulting from accidental or mistaken actuations of such external switches during such changeover can be eliminated.

The present invention basically comprises circuit means for generating periodic timekeeping signals, drive circuit means responsive to these timekeeping signals for producing drive signals to drive a stepping motor, externally actuatable switch means for producing display switching signals, circuit means for producing a train of rapid advancement signal pulses, first counter circuit means for counting and storing a count value representing the time difference between the first and second time information (e.g. the time difference between the current time and an alarm time) while the first time information is being displayed, second counter circuit means for counting and storing the difference between the first and second time information while the second time information is being displayed, and inhibit circuit means for controlling the supply of correction signals to the first and second counter circuits and the drive circuit means while changeover between display of the first and second time information is in progress, this changeover being performed by appropriate supply of rapid advancement signal pulses to the first and second counter circuit means. While such changeover is in progress, signals indicative of this are output from the first and second counter circuits, and these control the inhibit circuit means such as to inhibit any input of correction signal pulses to the first and second counter circuit means or the drive circuit means.

The operation of the present invention will be made more apparent by reference to the following description of a preferred embodiment.

DESCRIPTION OF THE PREFERRED EMBODIMENTS

Figure 1:
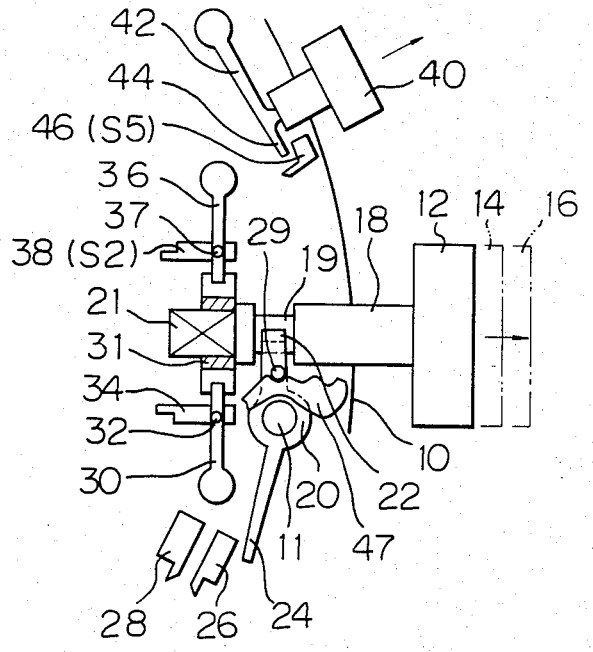
FIG. 1 is a partial plan view of an embodiment of an alarm timepiece according to the present invention, illustrating a correction switch mechanism.

Referring to the drawings, FIG. 1 is a plan view of the external operating mechanism of an embodiment of an alarm wristwatch according to the present invention. Numeral 10 denotes a baseplate, numeral 18 a winding stem, numeral 12 a crown, numeral 20 a setting lever having a tip 4*a* which fits into a groove portion 19 in winding stem 18 and which rotates about a pin 1*a* fixed in baseplate 10 as a center of rotation. A pin 29 is fixed in setting lever 20 on which a setting lever jumper 47 presses. As a result, crown 12 can be selectively set into three different stable axial positions, i.e. first, second and third axial positions.

Numerals 26 and 28 denote portions of a switch contact pattern, formed of a thin layer of copper on a circuit substrate, positioned such as to be respectively connectable to a switch spring portion 24 of setting lever 20 and to thereby respectively constitute display switches S3 and S4. Setting switch S3 in the closed state results in the timepiece being set in an alarm time display mode, as described hereinafter, so that this will be referred to as an alarm time display mode switch. Setting current time correction mode switch S4 in the closed state results in the timepiece being set in a current time correction mode, as described hereinafter, so that this will be referred to as a current time correction mode switch.

Numeral 31 denotes a switch wheel which is loosely coupled on a square cross-section portion 21 of winding stem 18, which passes through a corresponding square aperture formed in switch wheel 31 so that rotation of winding stem 18 is transmitted to switch wheel 31. Four tooth portions of switch wheel 31 are disposed such as to depress or to pluck (depending upon the direction of rotation) contact springs 30 and 36 which have base portions thereof fixed to the circuit substrate. Protrusions 32 and 37 formed respectively in constant springs 30 and 36 are set in contact with switch contact pattern portions 34 and 38 respectively, formed of a thin layer of copper upon the circuit substrate, when contact springs 30 and 36 are depressed. The latter assembly constitutes correction switches S1 and S2. Repetitive actuation of switch S1 results in rotation of the hands in the forward, i.e. clockwise direction, so that this will be referred to as the forward rotation correction switch, while actuation of switch S2 results in rotation of the hands in the counterclockwise direction, so that this will be referred to as the reverse rotation correction switch.

Numeral 40 denotes a control member generally referred to as a "push-pull button". This can be pulled outward from a normal first stable position shown in FIG. 1, to a second stable position (not shown in the drawings).

An alarm ON/OFF switch S5 is formed of a switch spring 42 having a base portion thereof fixed in the circuit substrate, and disposed such that when push-pull button 40 is pulled out by one step, a contact 44 of switch spring 42 comes into contact with a contact pattern portion 46 formed of a thin layer of copper on the circuit substrate,. Switch S5 controls enabling or inhibiting the audible output of an alarm signal, and so will be referred to in the following as an alarm ON/-OFF switch.

If crown 12 is pulled out to a second stable position, indicated as 14, then setting lever 20 is rotated in the clockwise direction, whereby switch spring portion 24 comes into contact with pattern portion 26, thereby setting alarm time display mode switch S3 in the closed state. In this condition, switch wheel 31 is in the same position as during normal operation, however the square cross-section portion 21 of winding stem 18 is sufficiently long that the rotation of crown 12 is transmitted to switch wheel 31. Thus, if crown 12 is rotated in a first direction in this condition, contact spring 30 will come into intermittent contact with pattern portion 34, so that forward correction switch S1 will be successively and repetitively set in the closed and open states, while if crown 12 is rotated in the opposite direction, then reverse correction switch S2 is intermittently set in the closed state. If crown 12 is pulled out by two steps, to the third stable position (indicated as 16), then setting lever 20 is further rotated so that switch spring portion 24 comes into contact with pattern portion 28 to thereby set current time correction mode switch S4 in the closed state. The switch wheel 31 remains in the same position as during normal operation, so that the rotation of crown 12 is transmitted to switch wheel 31 in the same manner as when crown 12 is in the second axial position. If push-pull button 12 is pulled out by one step in this condition, then contact 42 comes into contact with pattern portion 46, whereby alarm ON/-OFF switch S5 is set in the closed state.

Figures 2, 2A:
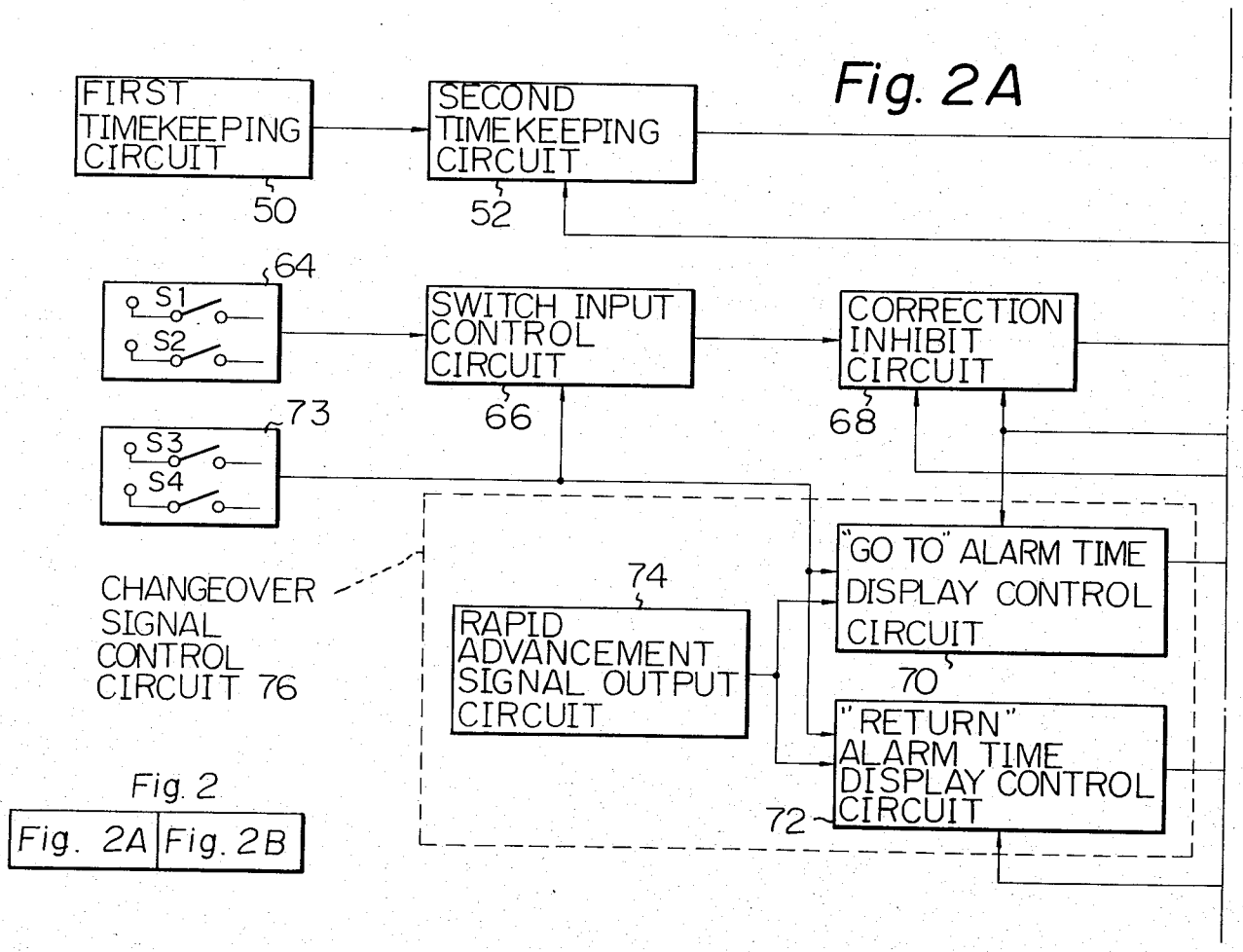
FIGS. 2A, 2B is a general block circuit diagram to illustrate the basic operation of the embodiment of FIG. 1.
Figure 2B:
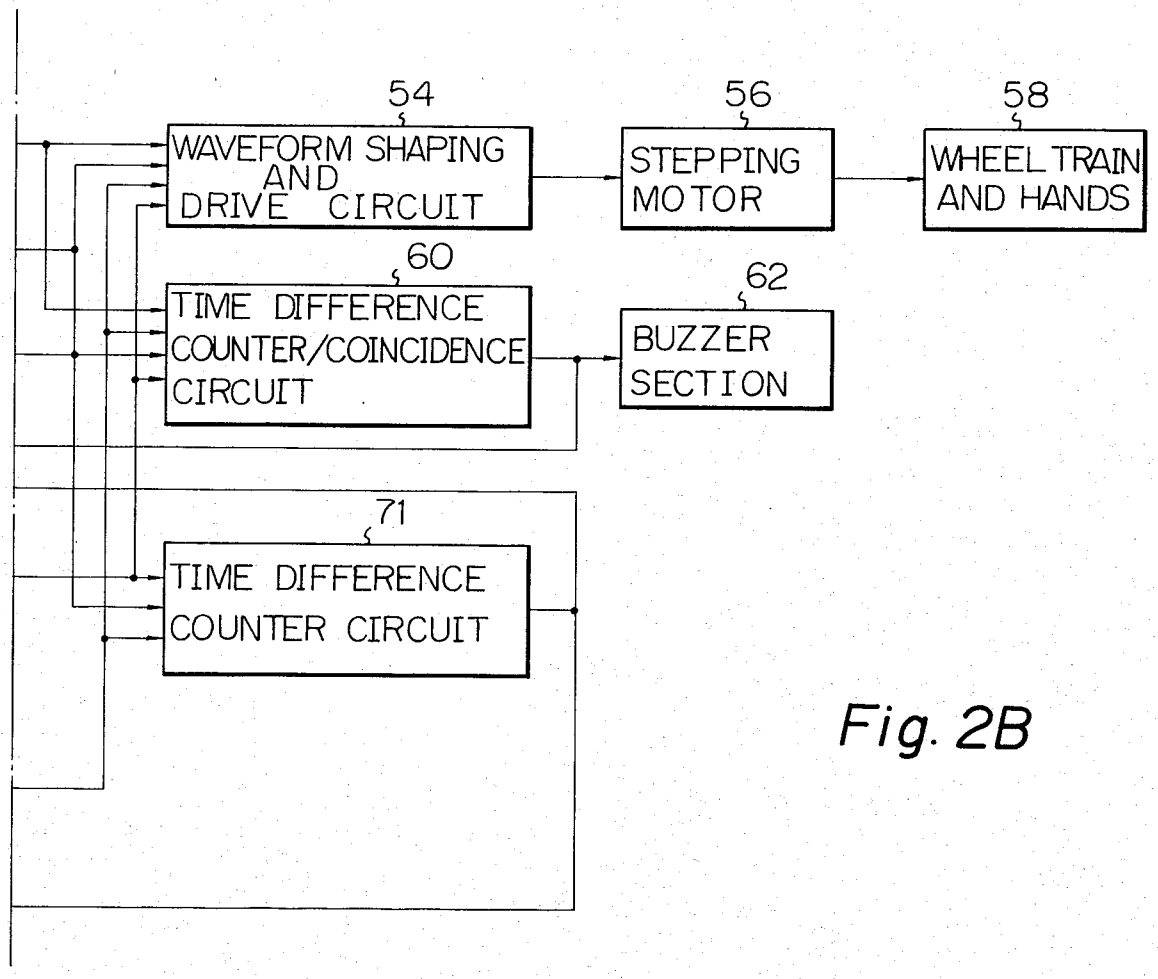

FIG. 2 is a block circuit diagram to illustrate the basic flow of signals in the alarm in the alarm wristwatch embodiment of FIG. 1. Numeral 50 denotes a first timekeeping circuit, which comprises a timebase oscillator circuit for producing a high-frequency timebase signal and a frequency divider circuit for frequency dividing the timebase signal to produce a timekeeping signal of the order of 32 Hz, for example. This output signal is input to a second timekeeping circuit 52 in which further frequency division takes place to produce an output signal comprising a pulse train having a period of 20 seconds, in this embodiment. Numeral 54 denotes a waveform shaping and drive circuit, which receives the 20-second period output signal from second timekeeping circuit 52 during the current time display mode and receives rapid advancement signal pulses during display changeover (as described in detail hereinafter), with these rapid advancement signal pulses designating either forward or reverse rotation of stepping motor 56. Waveform shaping and waveform shaping and drive circuit 54 produces drive signals in accordance with these input signals, which act to drive stepping motor 56 at a rate and in a direction designated by the input signals thereto. It should be noted that various waveform shaping and drive circuit means for producing selective rotation of the stepping motor of an electronic timepiece are well known in the art, so that no description of such circuit means will be provided in the following.

The torque output from stepping motor 56 is applied to a wheel train and hands system 58. The above circuits and mechanism are operative during normal (i.e. current time display) hands advancement operation.

Thus, in the current time display mode, the drive signals which are output from waveform shaping and drive circuit 54, and applied to stepping motor 56 act to drive stepping motor 56 by one step of rotation every 20 seconds. This rotation is transferred with speed reduction by the wheel train to advance the hands in the forward direction (i.e. the clockwise direction). The 20-second period signal which is input to time difference counter/coincidence circuit 60 is converted to a count value by a counter circuit within time difference counter/coincidence circuit 60. The latter circuit 60 monitors the difference between an alarm time and the current time, and outputs a coincidence signal to a buzzer unit 62 when these come into coincidence. The buzzer unit 62 can comprise an electro-acoustic transducer and a drive circuit for driving this.

The correction switch section 64 comprises switches S1 and S2 shown in FIG. 1, and is connected to a switch input control circuit 66. The output signals from switch input control circuit 64 are input through a correction inhibit circuit 68 to motor drive circuit 54, to time difference counter/coincidence circuit 60 and to a time difference counter circuit 71.

Display control switch section 73 comprises switches S3 and S4 shown in FIG. 1, and is coupled to switch input control circuit 66, to a "Go-to" alarm time display control circuit 70 which acts to produce display changeover from the first time information to the second time information display state, and to a "Return" alarm time display control circuit 72 which act to produce return from the second time information to the first time information display state of the hands. The "Go-to" alarm time display control circuit 70 and the "Return" alarm time display control circuit 72 receive a rapid advancement signal from rapid advancement signal output circuit 74, and are coupled to apply output signals to waveform shaping and drive circuit 54, time difference counter/coincidence circuit 60, and time difference memory circuit 71. The rapid advancement signal output circuit 74, the "Go-to" alarm time display control circuit 70 and the "Return" alarm time display control circuit 72 constitute a changeover signal control circuit 76. The "Go-to" alarm time display control circuit 70 receives control signals from time difference counter/coincidence circuit 60, while the "Return" alarm time display control circuit 72 receives control signals from time difference counter circuit 71. Output signals from interval counter circut 60 and from time difference counter circuit 71 are input to correction inhibit circuit 68.

In the following, it will be assumed that the two types of time information which can be displayed by the timepiece are the current time and an alarm time. The operating state in which the current time is displayed and the hands are periodically advanced will be referred to as the current time display mode. An operating state in which a preset alarm time is displayed, and can be corrected if desired, will be referred to as the alarm time display mode. An operating state in which the current time (at the instant of changeover into that state) is displayed with advancement of the hands halted, and in which the hands positions can be adjusted as desired, will be referred to as the current time correction mode.

When crown 12 is set in the second stable position (indicated by numeral 14 in FIG. 1), to set alarm time display mode switch S3 in the closed state, then the rapid advancement signal from rapid advancement signal output circuit 74 is transferred through the "Go-to" alarm time display control circuit 70, and output therefrom. This rapid advancement signal is input to waveform shaping and drive circuit 54, causing that circuit to apply a rapid advancement drive signal to stepping motor 56. As a result, the hands are rapidly advanced in the clockwise direction. In synchronism with this operation, the rapid advancement signal acts to reduce a count value representing the difference between the current time and a preset alarm time, which is held in time difference counter/coincidence circuit 50. The same number of rapid advancement signal pulses are input to be counted by time difference counter circuit 71.

When the count values representing the difference between the alarm time and alarm time, which is held in time difference counter/coincidence circuit 60 reach zero, then the "Go-to" alarm time display control circuit is caused to halt the output of the rapid advancement signal. The count value representing the time difference between the current time and the alarm time which was previously held in time difference counter/coincidence circuit 60 has now been transferred to time difference counter circuit 71, and the hands become halted at positions indicating the previously set alarm time. The timepiece is now in the alarm time display mode.

In this condition, the alarm time can be corrected by rotating crown 12 to repetitively set one of correction switches S1 and S2 in the closed and open states. Corresponding correction pulses are output from switch input control circuit 64. These pulses are transferred through correction inhibit circuit 68 to waveform shaping and drive circuit 54, causing corresponding drive signals to be output therefrom and applied to motor 56, resulting in forward rotation or reverse rotation of the hands.

At the same time, these correction pulses are input to time difference counter circuit 71, causing an increase or reduction of the count value held therein respectively, in accordance with the direction of rotation of the hands, these pulses being input in synchronism with the movement of the hands.

If now crown 12 is returned to the first position, to thereby set alarm time display mode switch S3 in the open state, then a rapid advancement signal from rapid advancement signal output circuit 74 is produced by "Return" alarm time display control circuit 72. This rapid advancement signal is input to waveform shaping and drive circuit 54. However in this case, as opposed to the case in which alarm time display mode switch S3 is in the closed state, a reverse rotation drive signal is output from motor waveform shaping and drive circuit 54, to produce reverse rotation of stepping motor 56.

The hands are thereby rapidly driven by reverse rotation. In synchronism with this operation, the rapid advancement signal acts to reduce the count value held in time difference counter circuit 71 and to input an identical number of pulses to be counted by time difference counter/coincidence circuit 60.

When the count value in time difference counter circuit 71 reaches zero, shortly thereafter, "Return" alarm time display control circuit 72 is caused to terminate output of the rapid advancement signal.

Accordingly, the time difference between the first time information and second time information held in time difference counter circuit 71 has now been restored to time difference counter/coincidence circuit 60. In addition, the hands are restored to positions which indicate the current time, while motor 56 is advanced successively in response to the 20-second period signal from second timekeeping circuit 52 in the normal current time display mode.

If crown 12 is set in the third position (denoted by 16 in FIG. 1), thereby setting current time correction mode switch S4 in the closed state, then if this change takes place from the alarm time display mode the hands are rapidly rotated into positions indicating the current time. An operating state which will be referred to as the current time correction mode has now been established, in which correction of the hands positions to indicate the current time can be carried out by actuation of correction switches S1 and S2.

More specifically, correction pulses which are produced in response to switching operations by forward correction switch S1 or reverse correction switch S2 are transferred through correction inhibit circuit 68 and switch input control circuit 64 to waveform shaping and drive circuit 54, and the corresponding output signal from waveform shaping and drive circuit 54 drives motor 56 to rotate the hands in the forward direction or reverse direction.

At the same time, the correction pulses are input to time difference counter/coincidence circuit 60, in synchronism with the movement of the hands, to increase or decrease the count value therein.

The operation which takes place during rapid advancement of the hands immediately after alarm time display mode switch S3 or Alarm ON/OFF switch S5 has been actuated will now be described. If crown 12 is pulled out to the second position, then the hands will be driven to indicate the alarm time by rapid advancement in the forward direction in response to the rapid advancement signal, as described hereinabove. However, since the time interval during which this rapid advancement of the hands takes place is relatively long, there is a danger that the user may accidentally touch or depress the correction switch section 140 during that time interval, to thereby cause erroneous actuation. In order to overcome this problem, the output from time difference counter circuit 71 is applied as a control signal to correction inhibit circuit 68, so that correction operation is inhibited while rapid advancement of the hands is in progress.

After the hands have reached the current time display state, an output signal from correction inhibit circuit 68 is applied as a reset signal to second timekeeping circuit 110, so that output of the 20-second period signal is halted, while setting of the hands can be carried out using the correction pulses.

From the above, it can be understood that, in the current time display mode, a count value whose magnitude represents the difference between the alarm time and the current time is held in time difference counter/-coincidence circuit 60, and that this value is successively decremented by the timekeeping signal input thereto from second timekeeping circuit 52. When the count value reaches zero, indicating the alarm time has been reached, an output signal is produced to activate buzzer 62. Furthermore, during the current time display mode, the count value in time difference counter circuit 71 is zero. When changeover from the current time to the alarm time display mode takes place, then the count value held in time difference counter/coincidence circuit 60 is effectively transferred into counter circuit 71, with the contents of circuit 60 becoming zero. It should be noted that the count value which is held in time difference counter/coincidence circuit 60 or in time difference counter circuit 71 at any particular instant does not represent an alarm time or current time value, but rather the difference between the current time and a preset alarm time, at that specific instant.

Figures 3, 3A:
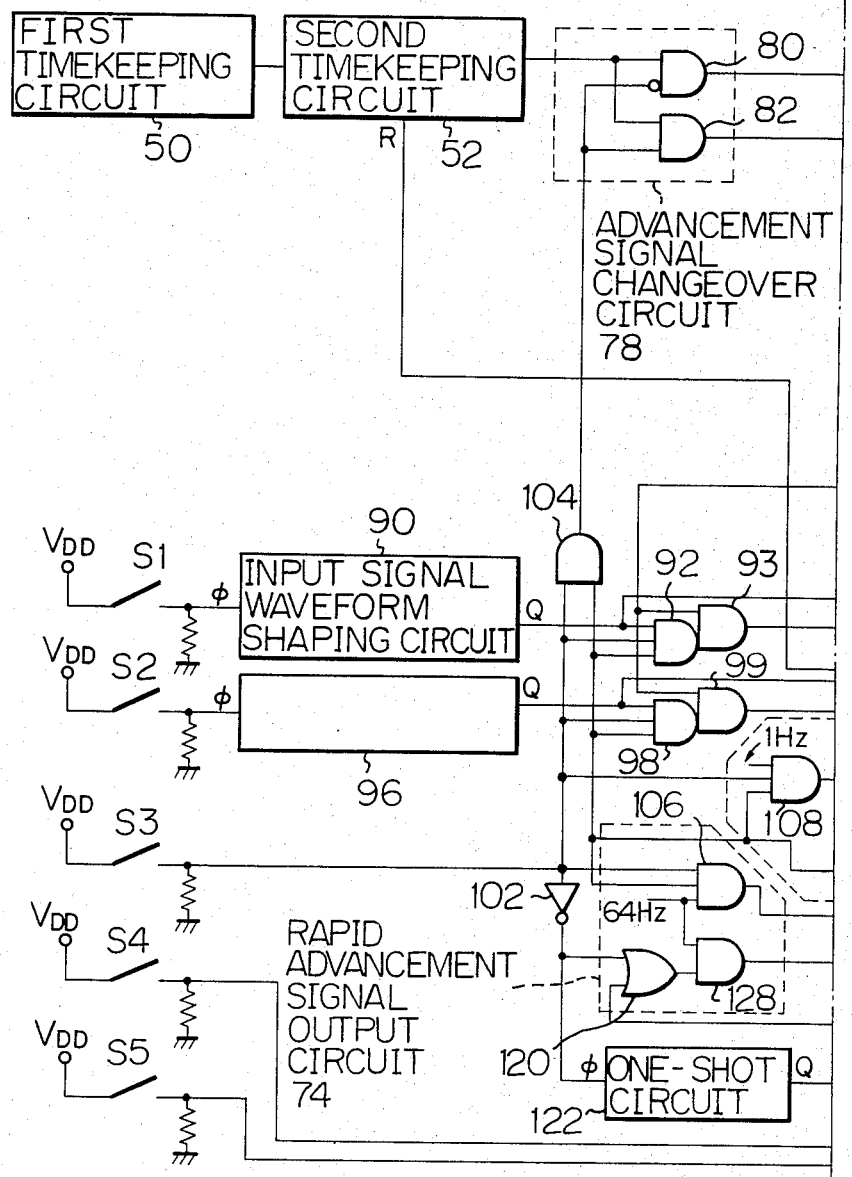
FIGS. 3A, 3B, 3C is a detailed block circuit diagram of the embodiment of FIG. 1.
Figure 3B:
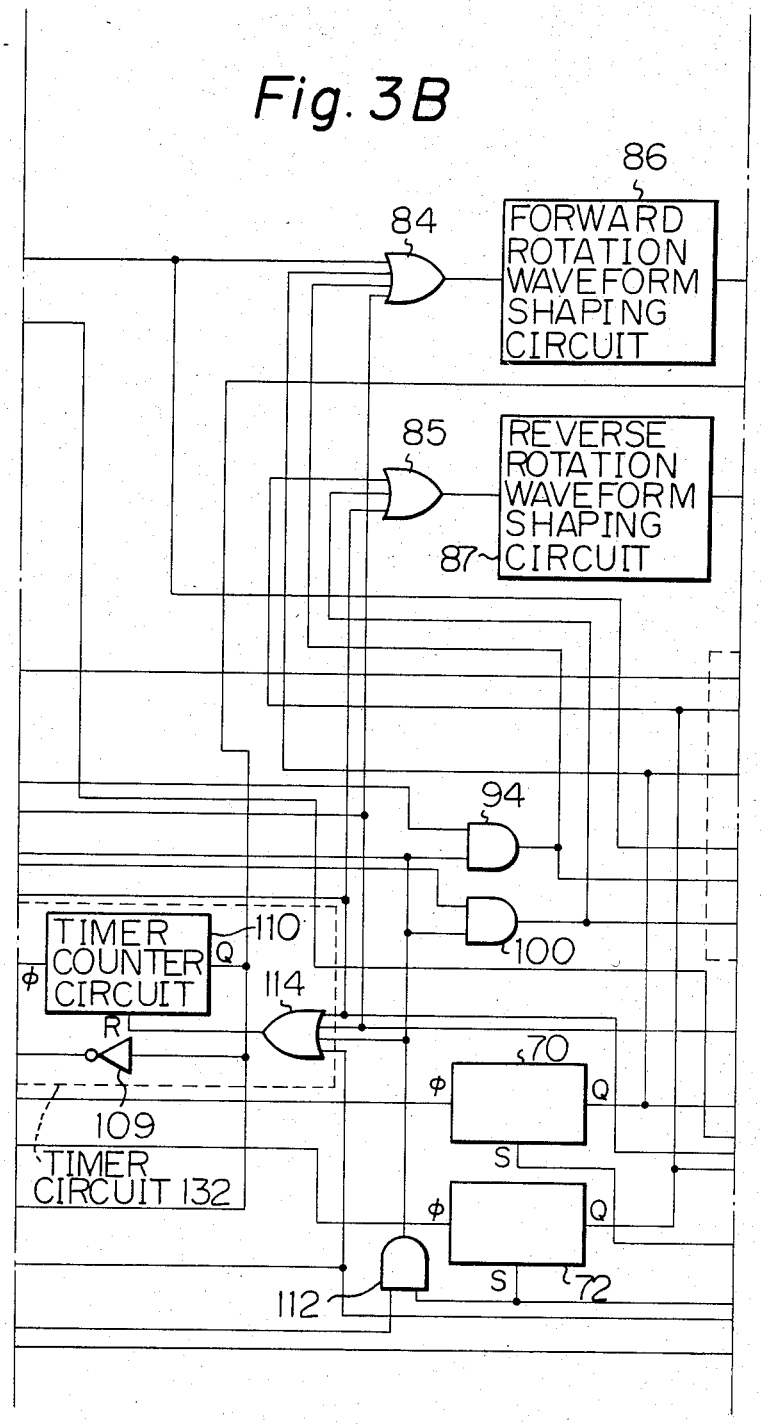
Figure 3C:
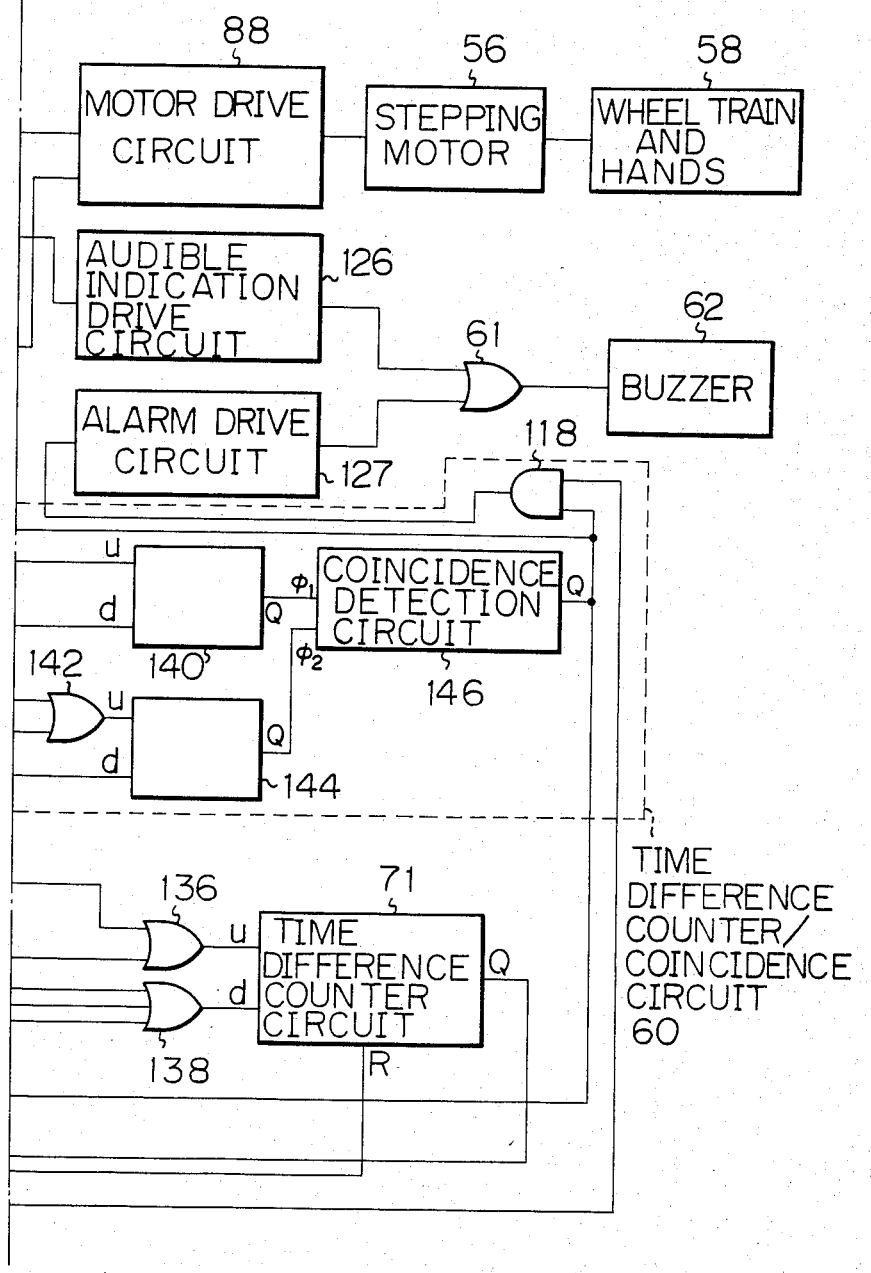

FIG. 3 is a detailed block circuit diagram of an alarm wristwatch, based on the embodiment of FIG. 2. The 20-second period signal which is produced from first timekeeping circuit 50 and second timekeeping circuit 52 is input to an inhibit AND gate 81 and to AND gate 82 in a advancement signal changeover circuit 78, and the output signal from inhibit AND gate 81 is transferred through an OR gate 84 to be input to a forward rotation waveform shaping circuit 86, which serves to produce a periodic drive input signal for driving stepping motor 56 and hence the hands into forward rotation. This drive input signal is subjected to current amplification by drive circuit 88, whose output signal is applied to drive motor 56. Normally, stepping motor 56 is driven by one step every 20 seconds, with forward rotation, to thereby advance the wheel train and hands (denoted as block 58 in FIG. 3).

If forward correction switch S1 is now intermittently actuated by rotation of crown 12, a switch output signal comprising a train of correction pulses is produced by an input signal waveform shaping circuit 90, which serves to perform switch debounce and timing operations for signals from forward correction switch S1. This switch output signal is input to AND gate 92 and to AND gate 94. Similarly, an input signal waveform shaping circuit 96 is coupled to reverse correction switch S2, and the correction signal pulses output therefrom are input to AND gate 98 and AND gate 100. Alarm time display mode switch S3 is coupled to the input of inverter 102 and to inputs of AND gates 92, 98, 104, 106 and 108.

A 1 Hz frequency signal is also input to AND gate 108, and the output from AND gate 108 is input to timer counter circuit 110. Current time correction mode switch S4 is coupled to an input of AND gate 112, whose output is coupled to inputs of OR gate 54, AND gate 94 and 100, and to the reset terminal R of second timekeeping circuit 110.

Alarm ON/OFF switch S5 is coupled to an input of AND gate 118. The output of inverter 102 is applied to an input of OR gate 114, and to a trigger terminal of a one-shot circuit 122. One-shot circuit 122 is triggered on the falling edge of the output signal from inverter 102. The output from one-shot circuit 122 is applied to OR gate 54, and to the reset terminal R of the time difference counter circuit 71. The Q output of timer counter circuit 110 is input to an audible indication drive circuit 126, and to inputs of OR gate 114 and inverter 109. The output from inverter 109 is input to AND gates 92, 98, 104, 106 and 108. The output signal from AND gate 104 is input to advancement signal changeover circuit 78. A 64 Hz signal is input to AND gate 128, which also receives as inputs the output signal from OR gate 120 and whose output signal is applied to "return" alarm time display control circuit 140. The 64 Hz signal is also input to an AND gate 106, whose output is applied to the "go-to" alarm time display control circuit 70.

A rapid advancement signal output circuit 74 is made up of an OR gate 120 and AND gates 128 and 106. Timer circuit 132 is made up of a timer counter circuit 110, AND gate 108, inverter 109 and OR gate 54, etc. The output signals from AND gates 92 and 98 are applied to inputs of AND gates 93 and 99, whose outputs are respectively applied to inputs of OR gate 54. The output signal from OR gate 54 is applied to the reset terminal R of timer counter circuit 110. In addition, the output from AND gate 93 is applied to inputs of OR gates 84 and 136, while the output signal from AND gate 99 is applied to inputs of OR gates 85 and 138. The output from OR gate 136 is applied to the "count up" terminal 'u' of time difference counter circuit 71, while the output from OR gate 138 is applied to the "count down" terminal 'd' of time difference memory circuit 71. The output signals from "go-to" alarm time display control circuit 70 and from "return" alarm time display control circuit 72, which control the operation of time difference memory circuit 71, are respectively applied to inputs of OR gates 84 and 85, and are also coupled to the "count up" terminal 'u' and the "count down" terminal 'd' of a relative alarm time memory circuit 140, described hereinafter The output signal from coincidence detection circuit 146 and from time difference counter circuit 71 are respectively applied to the set terminals S of "go-to" alarm time display control circuit 70 and "return" alarm time display control circuit 72. The output from time difference memory circuit 71 is applied to AND gate 112. The output signal from advancement signal changeover circuit 78 is input to OR gate 138.

The output signal from AND gate 94 is transferred through OR gate 142 to thereby be output from advancement signal changeover circuit 22, and so to be input to the "count up" terminal 'u' of a relative current time memory circuit 144. The output signal from AND gate 100 is applied to the "count down" terminal 'd' of a relative current time memory circuit 144, and is also applied to an input of OR gate 85.

The relative alarm time memory circuit 140 and relative current time memory circuit 144 each comprise an UP-DOWN counter circuit. The count values held in these circuits at any particular instant do not represent the absolute values of the current time or preset alarm time at that instant. Instead, the difference between the count value held in relative alarm time memory circuit 140 and that in relative current time memory circuit 144 represents the difference between the alarm time and the current time. Thus, irrespective of the absolute magnitudes of the count values in the relative alarm time memory circuit 140 and in the relative current time memory circuit 144, coincidence between the alarm time and the current time is indicated when these count values come into coincidence. In the current time display mode, the count value in relative alarm time memory circuit 140 is held fixed, and that in the relative current time memory circuit 144 is incremented successively by the 20-second period pulses from second timekeeping circuit 110. In the alarm time display mode, modification of a count value which is subsequently transferred to be stored in relative alarm time memory circuit 72, can be performed as described hereinafter.

The output signal from OR gate 85 is input to reverse rotation waveform shaping circuit 87, which serves to produce an output signal having suitable waveform for driving stepping motor 56 in the reverse direction. The output signal from reverse rotation waveform shaping circuit 87 is applied to drive circuit 88. The output signal from relative alarm time memory circuit 72 and the output signal from relative current time memory circuit 144 are input to coincidence detection circuit 146, which detects coincidence between these output signals. The output signal from coincidence detection circuit 146 indicating that such coincidence has occurred is input to an AND gate 118, whose output is applied to alarm signal drive circuit 127. The alarm signal drive circuit 127 serves to produce a signal whose waveform is suitable for acoustic reproduction as a chime sound, when alarm time coincidence is reached. The output signal from coincidence detection circuit 146 is also input to AND gates 93 and 99.

The output signal from audible indication drive circuit 126, which serves to produce signals of suitable waveform for generating single audible tone bursts, and the output signal from alarm signal drive circuit 127 are input to OR gate 61, whose output signal is applied to a buzzer 100.

The motor waveform shaping and drive circuit 54 in FIG. 2 is made up of the forward direction drive circuit 86, reverse rotation waveform shaping circuit 87 and drive circuit 88 in FIG. 3. The switch input control circuit 64 in FIG. 2 is made up of AND gates 92, 98, 94 and 100 in FIG. 3. The correction inhibit circuit 68 in FIG. 2 is made up of AND gates 93, 99, and 71, etc, in FIG. 3. The time difference counter/coincidence circuit 60 in FIG. 2 is made up of relative current time memory circuit 144, relative alarm time memory circuit 140, and coincidence detection circuit 146 in FIG. 3.

The operation of the circuit shown in FIG. 3 will now be described. In the normal operating state, the 20-second period signal produced by second timekeeping circuit 52 is output from inhibit AND gate 81 of advancement signal changeover circuit 22, and is transferred through OR gate 84 to forward rotation waveform shaping circuit 86. As a result, a drive signal is produced from motor drive circuit 88, which acts to drive motor 56 in the forward direction by one pitch every 20 seconds, thereby advancing the wheel train and hands.

In addition, the output signal from advancement signal changeover circuit 22 is transferred through OR gate 142, to be counted-up and so increment the contents of time relative current time memory circ 144. When the contents of time relative current time memory circ 144 and the contents of relative alarm time memory circuit 140 reach coincidence, a coincidence signal at the H level is output from coincidence circuit 146. In this case, if alarm buzzer ON/OFF switch S5 is in the closed state, i.e. if push-pull button 40 shown in FIG. 1 is pulled out by one step, then the coincidence signal is transferred to alarm signal drive circuit 127. The output signal from alarm signal drive circuit 127 is transferred through OR gate 77, and is thereby applied to buzzer 62 to produce an audible alarm signal.

When changeover to the alarm time display state is initiated by setting alarm time disp mode switch S3 in the closed state, i.e. crown 12 shown in FIG. 1 pulled out by one step to the second position thereof), the output signal from inverter 102 goes to the L level, whereby a single pulse is output from one-shot circuit 122. This pulse is transferred through OR gate 114, to thereby reset timer counter circuit 110 and time difference counter circuit 71 each to a count of zero. As a result, the Q output of each of these circuits goes to the L level.

The Q output signal from timer counter circuit 110 is then held at the L level for one minute, and during this time the output signal from inverter 109 remains at the H level. As a result, a 64 Hz signal is output from AND gate 106 of rapid advancement signal output circuit 74, and this signal is transferred through "go-to" alarm time display control circuit 70 and through OR gate 136 to be input to time difference counter circuit 71, to thereby increment the count value held in that circuit. The rapid advancement signal from "go-to" alarm time display control circuit 70 is also input to relative alarm time memory circuit 140, to thereby reduce the count value in that circuit, and is moreover transferred through OR gate 84 to forward rotation waveform shaping circuit 86, whereby a rapid advancement signal drive signal is output therefrom so that motor 56 and the hands are driven into rapid advancement forward rotation.

The H level signals from inverter 109 and alarm time disp mode switch S3 cause the output signal from AND gate 104 to go to the H level, so that advancement signal changeover circuit 22 produces the 20-second period signal from AND gate 82 thereof, with the output from AND gate 81 being halted.

As a result, normal advancement of the hands is halted, and the count value held in time difference counter circuit 71 begins to be reduced by rapid advancement signal pulses input thereto. Similarly, the count value in at memory circuit 140 is successively reduced, and when that count value reaches coincidence with the count value in time relative current time memory circ 144, an H level output signal is produced by coincidence circuit 146. This signal acts to set the "go-to" alarm time display control circuit 70, this having the effect of inhibiting transfer of the rapid advancement signal from rapid advancement signal output circuit 74 to forward rotation drive circuit 86, relative alarm time memory circuit 140 and time difference counter circuit 71. If alarm buzzer ON/OFF switch S5 is in the closed state, the output signal from coincidence circuit 146 is also transferred through AND gate 74, to be input to alarm signal drive circuit 127. As result, an audible alarm signal is emitted to notify the user when the hands have reached positions representing the preset alarm time.

It should be noted that it is possible either to arrange that the audible signal emitted when such coincidence is reached be made identical to the normal audible alarm signal, or to provide a separate coincidence signal drive circuit for producing a different signal from that which is produced by alarm signal drive circuit 127, with the output from such a separate coincidence signal drive circuit being input to OR gate 77 to thereby produce an audible signal indicative of alarm time coincidence.

When coincidence is reached, the hands are halted in positions indicating the alarm time, and this condition will be referred to as the alarm time display state.

The alarm time can now be adjusted by rotation of crown 12. Correction of the alarm time by forward rotation of the hands is accomplished by rotating crown 12 such as to repetitively actuate forward correction switch S1, to thereby produce forward rotation correction pulses, whereby a number of correction pulses proportional to the number of switch actuations are output from input signal waveform shaping circuit 96. These correction pulses are transferred through AND gate 92, to be output therefrom. Since alarm time disp mode switch S3 is in the closed state, an H level signal is output during the one-minute timer interval, from timer circuit 132, and this signal enables AND gate 92. The output signal from AND gate 92 in this case is transferred through AND gate 93, and through OR gate 114. The output from OR gate 114 acts to reset timer counter circuit 110, thereby resarting operation of that timer. The output signal from AND gate 93 also is transferred through OR gate 84, to forward rotation waveform shaping circuit 86. A drive input signal pulse is thereby output from forward rotation waveform shaping circuit 86 in response to each correction pulse, whereby motor 56 is driven in the forward direction, while in addition correction pulses are transferred through OR gate 136 to thereby increase the count value held in time difference counter circuit 71.

It can thus be understood that in this state, with the hands indicating an alarm time, correction of the hands positions by rotation in the clockwise direction will result in the contents of time difference counter circuit 71 (which represent the difference between the current time and the alarm time) being incremented by an amount which corresponds to the amount of correction applied to the hands.

If on the other hand crown 12 is rotated in the opposite direction to repetitively actuate reverse correction switch S2 so as to produce reverse rotation correction of the hands, then again in the same way as in the case of forward rotation correction, correction pulses are output from input signal waveform shaping circuit 96, in proportion to the number of correction switch actuations, and these are transferred through AND gate 98 and AND gate 99. The output signal from AND gate 99 is transferred through OR gate 114, and acts to reset timer counter circuit 110. The resultant output signal from AND gate 99 is also transferred through OR gate 85, to be input to reverse rotation waveform shaping circuit 87. A reverse rotation drive input signal pulse is thereby output for each correction pulse that is input to reverse rotation waveform shaping circuit 87, whereby motor 56 is driven into reverse rotation. IN addition, the correction pulses which are output from AND gate 99 are transferred through OR gate 138, and thereby act to reduce the count value in interval memory circuit 71.

Thus, as the hands are rotated to perform correction in the counter-clockwise direction, the count value representing the amount of difference between the alarm time and the current time which is held in time difference memory circuit 71 is reduced by an amount that is equivalent to the amount of hands correction performed.

If now crown 12 is returned to its original position, thereby setting switch 3 in the open state, the output signals from AND gates 92 and 98 become held at the L level, whereby input of signals from correction switches S1 and S2 is inhibited. In addition, the output signal from AND gate 104 is inverted to go to the L level, whereby the 20-second period signal is once more output from gate 81 of advancement signal changeover circuit 22, i.e. timepiece operation reverts to the normal advancement mode. In addition, the output signal from OR gate 120 in rapid advancement signal signal output circuit 74 goes to the H level, so that rapid advancement signal pulses at a frequency of 64 Hz are output from AND gate 128. These rapid advancement signal pulses are input to "return" alarm time display control circuit 72, and the resultant pulses which are output from "return" alarm time monitor control circuit 72 are input to OR gates 85 and 138 and to relative alarm time memory circuit 140.

As a result, drive signal pulses to produce rapid rotation of the hands in the reverse rotation are output from reverse rotation waveform shaping circuit 87 in synchronism with the rapid advancement signal pulses, whereby motor 56 is driven in the reverse direction so that the hands are rapidly rotated in the counter-clockwise direction. At the same time, the difference between the current time and the alarm time (memorized in time difference counter circuit 71) is transferred to relative alarm time memory circuit 140.

When the hands reach positions indicating the correct current time, output Q from time difference counter circuit 71 goes to the H level, thereby acting to hold "return" alarm time display control circuit 72 in the set state. This has the effect of inhibiting output of the 64 Hz rapid advancement signal from that circuit. The rapid reverse rotation of the hands is thereby halted, when they have reached the current time indicating positions, and thereafter normal current time periodic advancement of the hands is performed.

The above operations can also be described as follows, from the aspect of using the timepiece. If crown 12 of the timepiece shown in FIG. 1 is pulled out by one step to the second position (14), the hands will rotate rapidly in the clockwise direction towards positions indicating a previously set alarm time. When these positions are reached, the hands are halted to thereby provide a continuous alarm time display.

When the hands reach these alarm time indicating positions, a sound is emitted by the buzzer. If the alarm time thus displayed is to be corrected, then this can be done by rotating crown 12. To rotate the hands in the clockwise direction, crown 12 is rotated in the clockwise direction, while to rotate the hands in the counter-clockwise direction, crown 12 should be rotated in the counter-clockwise direction.

After the preset alarm time has been confirmed or altered, then returning crown 12 to the original (i.e. first) position will cause the hands to rapidly rotate in the counter-clockwise direction towards positions indicating the current time. When these current time indicating positions are reached the rapid rotation is halted and the normal current time operating condition is restored. The time duration for which crown 12 is left in the outward position is measured, so that return to display of the correct current time is achieved when the timepiece is restored to the current time display state.

While the hands are rapidly rotating towards the alarm time indicating positions, immediately after crown 12 has been pulled out to its second position as described above, no correction inputs will result from any actuations of forward correction switch S1 or S2. More specifically, during rapid advancement of the hands, the output signal from coincidence circuit 146 is held at the L level so that correction pulses that are output from AND gates 92 or 98 are inhibited from transfer through AND gates 93 or 99.

If crown 12 is pulled out by two steps to the third position (16) to establish the hands setting mode, then current time correction mode switch S4 is set in the closed state. The switch output signal thus produced is input to AND gate 71, whose output signal which is transferred through OR gate 114 to hold timer counter circuit 110 continuously reset, so that counting by that circuit is inhibited, and furthermore holding second timekeeping circuit 52 in the reset state so that output of the 20-second period signal therefrom is inhibited. In addition, one of the inputs of each of AND gates 94 and 100 is held at the H level.

If the timepiece is left this state, then hands advancement does not occur so that this can be thought of as an energy-saving mode. This operating mode can be utilized if the timepiece is to be left unused for some time. The positions of the hands can be adjusted, in this mode, by rotating crown 12.

In this operating state, actuations of forward correction switch S1 cause correction pulses to be output from output signal waveform shaping circuit 90, with the number of correction pulses being proportional to the number of switch actuations. These correction pulses are transferred through AND gate 94 and OR gate 84 and 142. The output signal from OR gate 84 is input to forward rotation waveform shaping circuit 86, resulting in corresponding forward rotation drive input pulses being output from forward rotation waveform shaping circuit 86. These result in drive signals from motor drive circuit 88 which produce forward rotation of motor 56 by an amount proportional to the number of switch actuations. In this way, the hand positions can be corrected as desired. The output signal from OR gate 142 acts to increment the time count value held in relative current time memory circuit 144, in synchronism with advancement of the hands.

If crown 12 is rotated in the opposite direction, then reverse correction switch S2 becomes successively actuated, so that in the same way as described above, correction pulses are output from input signal waveform shaping circuit 96 in proportion to the number of switch actuations, and these correction pulses are applied through AND gate 100 to OR gate 85 and to relative current time memory circuit 144.

The output signal from OR gate 85 results in reverse rotation drive pulses being output from reverse rotation waveform shaping circuit 87, whereby stepping motor 56 is driven into reverse rotation, by one pitch for each switch actuation to thereby produce hands rotation in the counter-clockwise direction. The input signal to relative current time memory circuit 144 acts to reduce the count value therein, in synchronism with rotation of the hands.

When crown 12 is in this third position, i.e. with the timepiece in the hands correction mode, the Q output of time difference counter circuit 71 is at the L level so that the output signal from AND gate 71 remains at the L level irrespective of whether signals are input thereto from switch S4, while changeover of the hands positions to the alarm time monitor state is in progress, while the timepiece remains in the alarm time monitor state, and during return from the alarm time state to the current time display state. Thus, no input signals can be received from forward correction switch S1 or reverse correction switch S2 during any of these operating conditions. In addition, second timekeeping circuit 52 is held in the reset state during these operating states, so that no timekeeping errors can be produced.

When the hands reach the current time indicating positions (with this condition being initiated as described hereinabove by setting switch S3 in the open state while switch S4 is in the closed state,) the Q output of time difference counter circuit 71 goes to the H level and the output of AND gate 71 therefore goes to the H level. Adjustment of the hands positions can now be carried out as described above.

There are certain problems which may arise with regard to pull-out and push-out operations of crown 12, as will now be discussed. Firstly, when crown 12 is pulled out by two steps (i.e. to position 16 in FIG. 1), to perform adjustment of the hands positions, or is returned from the latter position adjustment has been completed, to the normal position, crown 12 will momentarily pass through the one-step position (i.e. position 14 in FIG. 1), so that alarm time display mode switch S3 will momentarily be actuated.

As a result, the timepiece may begin alarm time monitor operation accidentally, when the user attempts to perform adjustment of the current time hands position, resulting in movement of the hands. This will cause the user to feel some doubts concerning the timepiece operation. These problems can be overcome by inserting a delay circuit to provide a delay time of the order of 0.5 seconds in the circuit immediately after alarm time display mode switch S3.

The user will frequently perform confirmation and alteration of the preset alarm time, and as a result consideration must be given to the possibility that crown 12 may be accidentally pulled out by two steps, and the time information thereby accidentally altered. This problem can be avoided by inserting a delay circuit having a delay of the order of 0.5 seconds in circuit immediately after switch S4. If this is done, and if the user immediately pushes crown 12 back inward after having accidentally pulled it out to the second position (position 16), then this problem can be avoided.

In addition, to prevent problems similar to those described above occurring immediately after changeover to the hands position correction state takes place (in which correction can be carried out using switches S1 and S2), it is possible to provide a delay circuit in correction inhibit circuit 68, to operate such that correction operations are inhibited until the buzzer sound indicating completion of hands position changeover has been emitted.

If the timepiece is left in the alarm time monitor state (i.e. the state in which crown 12 is set in the second position 14), then an automatic restoration function will come into operation. If alarm time display mode switch S3 is left in the closed state and a period of one minute elapses during which no inputs are supplied from switches S1, S2 or S4, then the Q output of timer counter circuit 110 is inverted to go to the H level.

As a result of this H level output, the output from inverter 109 goes to the L level, so that output of the 1 Hz signal to timer counter circuit 110 through AND gate 108 is terminated. Furthermore, since the outputs of AND gates 92 and 98 are held at the L level, input of switch signals from switches S1 and S2 is inhibited. In addition, the output from AND gate 104 goes to the L level, so that the output from advancement signal changeover circuit 22 produces the normal current time advancement operation with 20-second period rotation of stepping motor 56 being performed in response to the output signal from forward rotation waveform shaping circuit 86. In addition, time accumulation operation by relative current time memory circuit 144 begins, in response to the output signal from OR gate 142. In this way, return to the normal hands advancement operation is implemented automatically.

In addition, as a result of the H level output from timer counter circuit 110, the output signal from OR gate 120 of rapid advancement signal output circuit 74 goes to the H level, whereby the 72 Hz rapid advancement signal is output from AND gate 128.

The rapid advancement signal is transferred through "return" alarm time display control circuit 72 and OR gate 138, to be input to time difference counter circuit 71 and to reduce the count value therein. As a result, the rapid advancement signal continues to be output from control circuit 72 until the count value in time difference counter circuit 71 reaches zero. This rapid advancement signal is transferred to relative alarm time memory circuit 140, in which it acts to restore the count value in time difference counter circuit 71 and also is transferred through OR gate 72 to reverse rotation waveform shaping circuit 87, resulting in stepping motor 56 being driven in the reverse direction. The hands are thereby rotated in the reverse direction, until they reach positions indicating the current time.

The above operations are the same as those which occur when alarm time display mode switch S3 is in the open state, as described previously. The H level output from timer counter circuit 110 is input to acoustic indication drive circuit 126, which thereby produces an output signal that is transferred through OR gate 77 to buzzer 62. An audible sound is thereby emitted by the buzzer, to indicate to the user that the automatic recovery function has operated. If the user should leave crown 12 pulled out into the second position 14, i.e. pulled out by one step, and ignores the latter audible indication, then since relative alarm time memory circuit 140, relative current time memory circuit 144 and coincidence detection circuit 146 all operate in the same manner as during the normal time display state, the audible alarm signal will be emitted when the alarm time is reached. It can thus be understood that if the timepiece is deliberately or accidentally left in the condition described above, after the alarm time has been confirmed, the alarm function will continue to operate normally. If on the other hand crown 12 is once more pulled out to the second position, after having been returned to the first position, then timer counter circuit 110 will be reset to its initial condition, so that this will prevent any confusion being caused to the user, and the alarm time monitor or alarm time correction functions can again be utilized.

The alarm time memory circuit 140, relative current time memory circuit 144 and time difference counter circuit 71 can each be arranged to overflow in synchronism with the hands reaching the 12 o'clock position, i.e. each circuit can have a maximum count corresponding to 12 hours.

It should also be noted that these counting and memory circuits can all be implemented as a system, within a microcomputer chip, with execution being controlled by a CPU, and the counter and memory circuits being formed by RAM. In this case, the rapid advancement signal output circuit 74, which produces the rapid advancement signal in this embodiment, can be made a part of the forward rotation waveform shaping circuit 86 or the reverse rotation waveform shaping circuit 87, in order to reduce circuit size. Alternatively, the circuit can be formed using a ROM or RAM.

Furthermore, the embodiment described above comprises a wristwatch provided with an alarm function. However, the present invention can also be employed to provide some other type of additional time function in a timepiece, for example a timer function in a chronograph, a "remaining time" function in a timer-equipped timepiece, or a "world time" function, in a similar manner to that described above.

As described in the above, the present invention prevents erroneous correction of the timepiece while the hands are undergoing display changeover. Thus, even if the user has the impression that a long time has elapsed after such changeover has been initiated, and performs an accidental or meaningless correction operation while changeover of the hands is in progress, there will be no errors in the time information displayed after such changeover has been completed. This is highly effective in preventing the user from feeling any uncertainty concerning the timepiece operation.

The invention is applicable in general to multifunction timepieces having hands type of time display, using a single hand or a pair of hands to provide a number of display functions.

Although the invention has been described in the above with reference to a specific embodiment, it should be noted that various changes and modifications to these embodiments may be envisaged which fall within the scope claimed for the invention, as set out in the appended claims. The above specification should therefore be interpreted in a descriptive and not in a limiting sense.

What is claimed is:

1. In a hands display electronic timepiece controllable to display a plurality of types of time information including at least first and second time information and provided with time display means comprising time indicating hands, circuit means for generating said first and second time information, externally operable means for producing signals selectively designating display of said first and second time information and circuit means responsive to said designating signals for producing signals acting to change the positions of said hands such as to indicate said designated time information, a correction system comprising:

correction circuit means externally controllable for correcting at least one of said first and second time information; and inhibit circuit means for rendering said correction circuit means effectively inoperative during a time interval which is synchronized with and of identical duration to a time interval during which changeover of said hands between positions indicating said first and second time information is in progress.

2. A correction system for a hands display type of electronic timepiece controllable to display a plurality of types of time information including at least the current time and an alarm time, said electronic timepiece comprising circuit means for generating a fixed frequency timekeeping signal, drive circuit means responsive to said timekeeping signal for generating corresponding drive pulses, a wheel train and hands coupled to said motor whereby said hands are periodically advanced by said motor to indicate said current time while the timepiece is in operating in a current time display mode, and externally actuatable display switch means for producing signals to selectively designate operation in said current time display mode and alarm time display mode, said correction system comprising:

first time difference counter circuit means for storing a count value representing the time difference between said alarm time and said current time when operating in said current time display mode, and for producing signals to indicate that said count value represents a time difference other than zero;

second time difference counter circuit means for storing a count value representing the time difference between said alarm time and current time while operating in an alarm time display mode;

changeover signal generating circuit means controlled by designation signals from said display switch means designating changeover from said current time display mode to said alarm time display mode for applying train of relatively high frequency advancement signal pulses simultaneously to said drive circuit means, to said first time difference counter circuit means to decrement the count value thereof and to said second time difference counter circuit means to increment the count value thereof, application of said advancement signal pulses being continued until the count value in said first time difference counter circuit means has reached a value representing a time difference of zero, said advancement signal pulses being applied to said motor drive circuit means such as to produce rotation of said hands into positions indicating said alarm time, said changeover signal generating circuit means being further controlled by output signals from said display switch means designating changeover from said alarm time display mode to said current time display mode for applying a train of said advancement signal pulses simultaneously to said motor drive circuit, said first time difference counter circuit means to increment the count value therein and to said second time difference counter circuit means to decrement the count value therein, application of said advancement signal pulses being continued until the count in said second time difference counter circuit means reaches a value representing a time difference of zero, said advancement signal pulses being applied to said drive circuit means such as to produce rotation of said hands into positions indicating said current time;

externally actuatable switch means for generating correction signal pulses for correcting at least said alarm time; and inhibit circuit means coupled between said correction switch means and said second time difference counter circuit means and controlled by said output signal from said first time difference counter circuit means indicating a time difference other than zero for enabling transfer of said correction signal pulses to said second time difference counter circuit means when said alarm time display mode has been entered and the count value in said first time difference counter circuit means has reached a value representing a time difference of zero, and for inhibiting the transfer of said correction signal pulses to said second time difference counter circuit means so long as the count value in said first time difference counter circuit means represents a time difference other than zero.

3. A correction system according to claim 2, and further comprising buzzer means coupled to receive said output signal from said first time difference counter circuit means for producing an audible alarm when the count value in said first time difference counter circuit means reaches a value indicating a time difference of zero while operating in said current time display mode.

4. A correction system according to claim 2, in which said second time difference counter circuit means produce an output signal to indicate that the count value therein rerpesents a time difference other than zero, and in which said changeover signal generating circuit means comprise:

circuit means for generating a continuous train rapid advancement signal pusles;

first alarm time display control circuit means controlled by said output signal from said first time difference counter circuit means and signals from said display switch means designating changeover from said current time display mode to said alarm time display mode, for transferring said rapid advancement signal pulses to decrement the count value in said first time display counter circuit means and increment the count value in said second time difference counter circuit means, and to be input to said motor drive circuit means, with said transfer being continued until the count in said first time difference counter circuit means reaches a value representing a time difference of zero, whereby said hands are rotated into positions indicating said alarm time;

second alarm time display control circuit means controlled by said output signals from said second time difference counter circuit means and signals from said display switch means designating changeover from said alarm time display mode to said current time display mode for transferring said rapid advancement signal pulses to increment to count value in said first time display counter circuit means and to decrement the count value in said second time display counter circuit means, and to be input to said motor drive circuit means, with said transfer being continued until the count value in said second time difference counter circuit means reaches a value representing a time difference of zero, with said motor drive circuit means being operated such as to produce rotation of said hands in the opposite direction to said changeover from the current time to the alarm time display mode whereby said hands are rotated into positions indicating said current time.

5. A correction system according to claim 4, in which said output signal from said second time display counter circuit means is applied to control said inhibit circuit means such as to inhibit transfer of said correction signal pulses therethrough after changeover from said alarm time display mode to the current time display mode has been designated by actuation of said changeover switch means and the count value in said second time display counter circuit means has a value representing a time difference other than zero.

* * * * *